US005080439A

United States Patent [19]

Takahashi et al.

[11] Patent Number: 5,080,439

[45] Date of Patent: Jan. 14, 1992

[54] PROTECTIVE INFANT CHAIR FOR USE IN TOILET

[75] Inventors: Takehiko Takahashi, Tokyo; Yuji Shimizu, Aichi, both of Japan

[73] Assignee: Combi Corporation, Tokyo, Japan

[21] Appl. No.: 524,942

[22] Filed: May 18, 1990

[30] Foreign Application Priority Data

Sep. 4, 1989 [JP] Japan ..... 1-103149[U]

[51] Int. Cl.[5] ..... A47C 31/00

[52] U.S. Cl. ..... 297/464; 297/487; 297/216

[58] Field of Search ..... 297/464, 467, 468, 484, 297/486, 483, 487, 257, 488, 216, 217

[56] References Cited

U.S. PATENT DOCUMENTS

| | | | |
|---|---|---|---|
| 3,466,091 | 9/1969 | DeGrusso | 297/486 |
| 3,992,057 | 11/1976 | Studebaker | 297/464 |
| 4,065,179 | 12/1977 | Takasaki | 297/464 |
| 4,441,221 | 8/1984 | Enste et al. | 297/464 X |
| 4,568,122 | 2/1986 | Kain | 297/216 X |
| 4,674,800 | 6/1987 | Ensign | 297/464 X |
| 4,723,493 | 2/1988 | Siani et al. | 297/464 X |
| 4,790,593 | 12/1988 | Davacos et al. | 297/216 X |
| 4,813,746 | 3/1989 | Mulholland | 297/464 X |
| 4,906,047 | 3/1990 | Mikami | 297/464 |

FOREIGN PATENT DOCUMENTS

| | | | |
|---|---|---|---|
| 1376495 | 9/1964 | France | 297/486 |
| 61-100743 | 6/1986 | Japan . | |

*Primary Examiner*—Jose V. Chen

*Attorney, Agent, or Firm*—Sughrue, Mion, Zinn, Macpeak & Seas

[57] ABSTRACT

An infant restraining chair for installation in a corner or other compact area of a bathroom, for restraining an infant while the infant's guardian makes use of bathroom facilities. A chair supporting and surrounding a substantial portion of an infant's body is mounted on top of a column having a cross-section of a generally triangular shape. Arcuate seat belt portions of substantially rigid construction are maintained in a body of the chair normally in a position retracted into the chair, but are selectably extendable out of the chair body to encircle and restrain an infant seated in the chair.

14 Claims, 3 Drawing Sheets

PROTECTIVE INFANT CHAIR FOR USE IN TOILET

FIELD OF THE INVENTION

The present invention relates to an infant chair for installation and use in public spaces such as public lavatories, public conveniences, or the like, where a large number of unspecified persons visit, and more particularly to an infant chair which is constructed in such a manner that a protective frame provided in the main body of the chair is arranged to extend from the back part of the seat to enclose the front region of the chair at the height of an armrest, so that the infant seated in the said is confined and protected therewith for safety.

BACKGROUND OF THE INVENTION

A guardian, such as a mother, travelling in public and being accompanied with an infant who is still unable to take care of himself, frequently feels much inconvenience because of the absence of an adequate arrangement for safely accommodating and protecting the infant when the person desires to use a public lavatory or adjust her makeup or tidy her dress.

Some facilities, such as department stores and railway stations, have gradually come to furnish small-sized beds (such as baby cots) for keeping the infant therein or small chairs in some places in lavatories and powder rooms in an attempt at dealing adequately with such problems. However, the use of a baby cot or the like has shortcomings in that it occupies a large space inside a lavatory or a powder room because of the large size of a baby cot, with the result that the total area of the lavatory is eventually reduced. Also such arrangements fall short of consideration for the safe confinement and protection of the infant in case the infant accommodated in a baby cot moves about therein.

Accordingly, guardians have been typically inconvenienced in that, in a place where a baby cot or the like is not provided or even in a place where a baby cot or the like is provided, a guardian has been obliged to enter a compartment in a lavatory together with the infant to relieve herself while keeping an eye on the infant for safety as mentioned above.

Furthermore, although it is proposed in the Official Gazette for Utility Model Laid Open No. 100743-1986 that a chair for an infant be installed inside a lavatory compartment, the baby chair is a common-type chair with the main body thereof being composed of the back part and the seat part and with a handrail provided to extend from the back part at the height of the armrest to enclose the front region of the said chair, and with a slip-preventing band being provided between the central region at the fore ends of the handrail and the central part of the front part of the seat.

The baby chair of the type mentioned above is ordinarily constructed with both the handrail and the slip-preventing band fixed rigidly, and consequently it is necessary to put the baby in the chair and to remove him from the chair from a point over the main body of the chair, and it is therefore necessary to lift the infant to a high level. It often happens that infant lifting cannot be done smoothly to set the infant in the chair and to remove him from the chair because the infant legs (often kicking) tend to interfere with the handrail and also with the slip-preventing band of the chair.

SUMMARY OF THE INVENTION

The present invention is directed to dealing adequately with the problems mentioned above in consideration of the circumstances described hereinabove. Specifically, an object of this invention is to offer an infant chair which can be set easily and in a simple way in a limited space, such as a corner in a toilet, a powder room or a lavatory compartment, and is also provided with a protective frame structured so as to protect, confine and control the seated infant in safety and in a secure manner.

Another object of this invention is to offer an infant chair which permits ease and smoothness in seating the infant in the chair and removing him therefrom, such chair being provided with a protective frame having extremely simple operating means for the clamping and release of the frame unit (the protective frame) for protecting the infant seated in the chair.

This invention has its essential features in a construction of an infant chair comprised of: a seat part, wherein the back part thereof is formed into the back support and the front part thereof is formed into an open region on an upper area of the main body of the chair which is formed in a columnar shape, a triangular shape, or another shape having an appropriate height; and, two semicircular arc protective frame members provided on the inside area of the back support in a manner permitting the members to be drawn out freely, so as to encircle and confine the waist and front abdominal region of the infant from both sides of the back support, the protective frame members as drawn out as mentioned above, forming a state of their closure by detachable engagement of their fore ends in the central area in the front part of the open region or in front of the infant seated thereon.

BRIEF DESCRIPTION OF THE DRAWINGS

The manner by which the above objects and other objects, features and advantages of the present invention are attained will be fully evident from the following detailed description when it is considered in light of the drawings, wherein.

BRIEF DESCRIPTION OF THE PREFERRED EMBODIMENTS OF THE INVENTION

Figure 2:
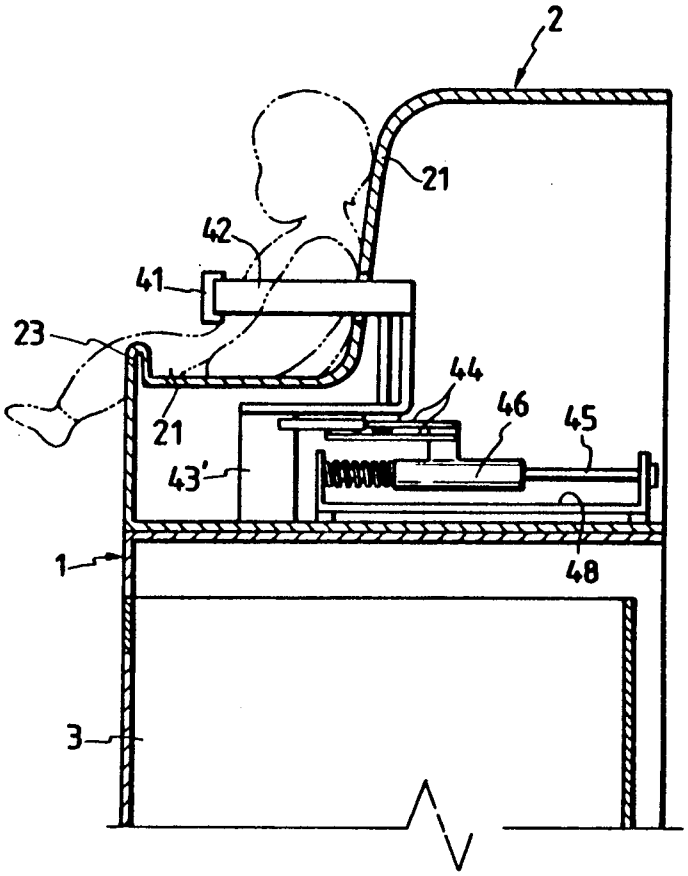
FIG. 2 is an enlarged sectional view of the principal parts showing protective frame members in a state of closure with an infant seated in the chair.
Figure 1:
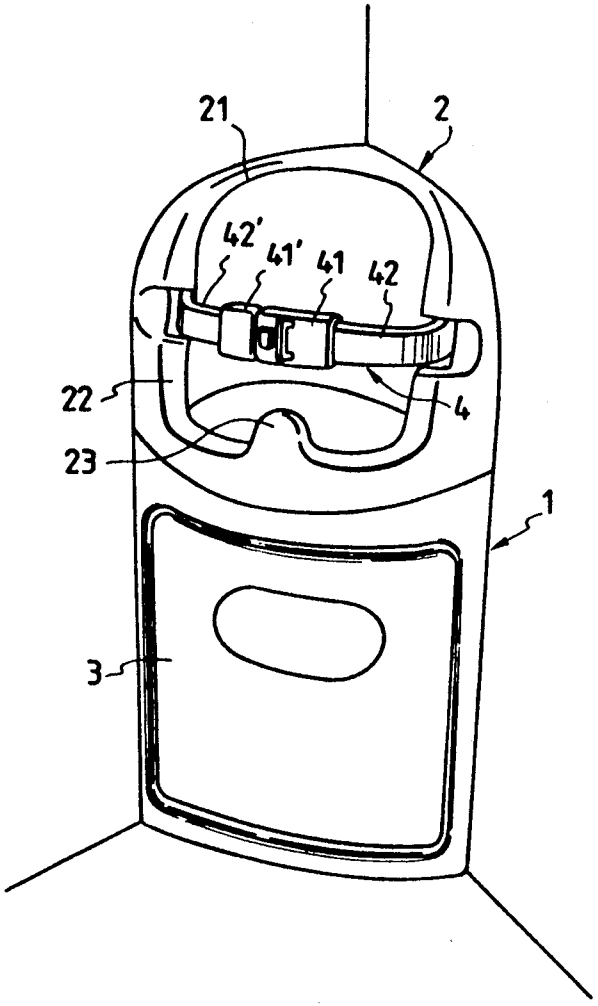
FIG. 1 is a perspective view illustrating an embodiment of the infant chair according to the present invention in a state with the protective frame members being closed.
Figure 3:
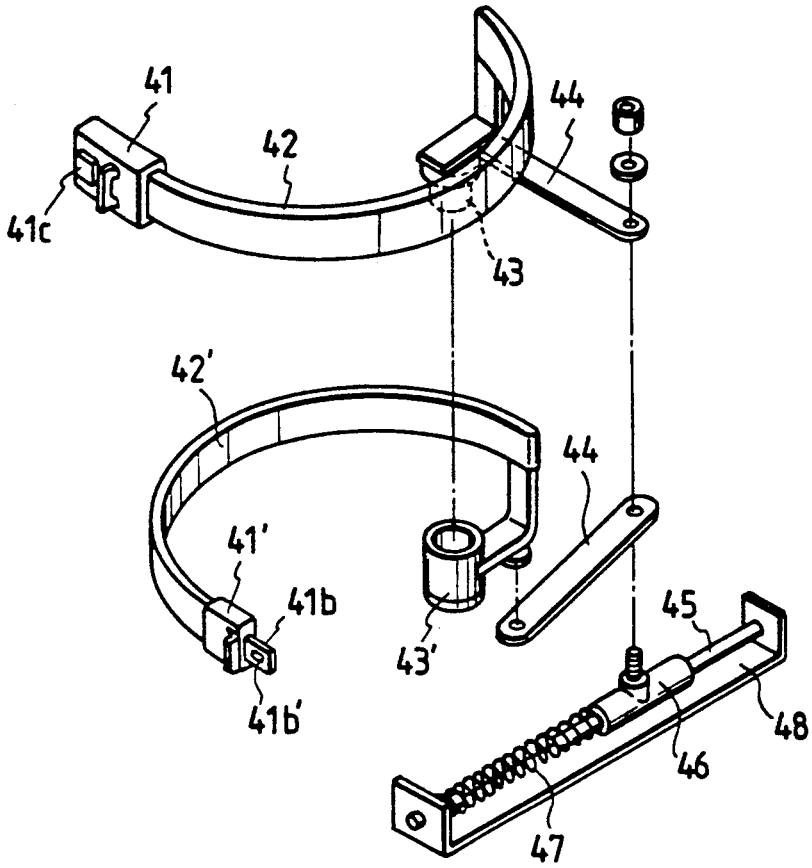
FIG. 3 is an exploded perspective view of the opening and closing structures of the protective frame members.
Figure 4:
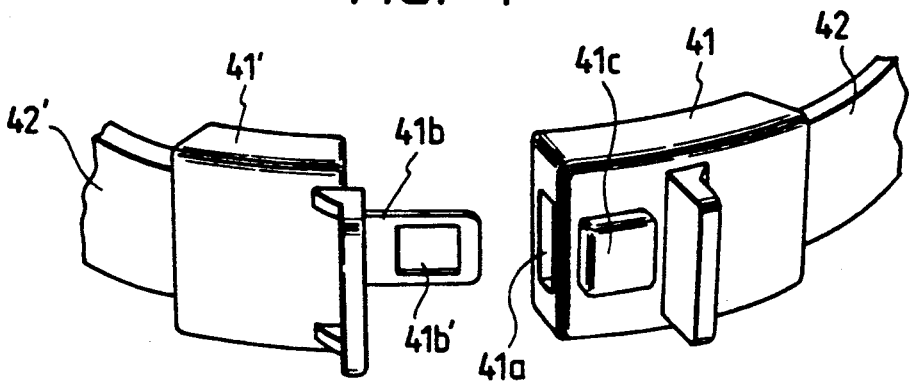
FIG. 4 is an enlarged perspective view illustrating a clamping device for the protective frame members.

Reference will now be made in detail to the construction according to the present invention as illustrated in the accompanying drawings, in which like reference characters designate like or corresponding parts throughout the several drawings.

In the description to follow, preferred embodiments of the present invention are presented as examples. It should be understood, however, that the present invention is not limited to these examples of its embodiment, but may be applied effectively to other forms which do not deviate from the technical scope of the present invention as defined in the appended claims.

An embodiment of the present invention will be described in detail with reference to the FIGS. 1 through 6.

Item 1 represents a main body of the chair having an adequate height, and is formed in such a way as to make the sectional shape thereof an approximately triangular column. A seat 2 is formed of a single or multiple pieces in the upper part of the main body of the chair with a back support 21 fabricated in an upright position at an appropriate height in the back area, and an opening region 22 formed in the front area thereof.

Partition or projection 23 represents a crotch holder formed in an upright position at a moderately low height in the central position on a front rim of the opening region 22, and is for the purpose of preventing the infant seated on the seat 2 from moving in the forward direction when seated and consequently slipping from the seat 2.

Moreover, while the sectional shape of the main body of the chair is shown in an approximately triangular column in this example of embodiment, it is to be understood that the sectional shape of the main body of the chair is not limited to this form, but can of course be modified to any other appropriate sectional shape, such as a cylindrical column and a rectangular column. Yet, when the sectional shape of the main body 1 of the chair is formed in an approximately triangular column in its section, it is possible to install the chair in a manner adaptive to the corner part of a lavatory compartment, a powder room, or the like, and this sectional shape, therefore, offers the advantage that it makes it possible to use a dead space in the room effectively.

Item 3 indicates a commodity container formed in the lower part of the main body 1 of the chair, and this container can be used also as a trash box in addition to its utilization as a space for temporary accommodation of personal effects.

Item 4 indicates a protective frame or restraining means installed in such a way as to permit free projective and retractive movement out of and into both sides of the back support 21, and the protective frame is so designed that only the clamping means 41 and 41' formed at the fore ends of the protective frame will constantly remain exposed from the front edges of the back support 21.

The protective frame 4 mentioned above is composed of the combination of two frame members 42 and 42' in a semicircular arc shape with the clamping means 41 and 41' provided on the fore ends, as illustrated in FIG. 2 through FIG. 5. More particularly, the frame is constructed in such a way as to form an annular shape in its overall plane figure by setting the axis 43 formed in the base end part of one frame member 41 into the supporting cylinder 43' provided in the base end part of the other frame member 42'. The arrangement's provided in such a manner as to permit the free swaying or scissoring movement of the frame members, and also, the supporting cylinder 43', which supports the axis 43, is installed on the main body 1 of the chair in a manner permitting the free swaying movement of the supporting cylinder 43' (FIG. 2).

Items 44 and 44 represent links for effecting a swaying movement, with their fore ends installed in the proximity of the base end parts of the frame members 42 and 42', and the base end parts installed on the sliding motion unit 46, which is used for driving the frame members for their opening and closing operations and installed on the sliding motion guide rod 45 in a manner permitting a free sliding motion.

The sliding motion unit 46, which applies force to the protective frame 4 in such a way as to bias the frame toward a constantly open state, exerts force in such a way that the sliding motion unit 46 is thrust back to the rear position of the sliding motion guide rod 45 by the springing force of the spring 47 mounted on the sliding motion guide rod 45.

Item 48 represents a base for supporting the sliding motion guide rod 45, and this base is fixed rigidly on the main body 1 of the chair.

The clamping means 41 and 41' (FIG. 4), which are installed on the fore end parts of the protective frame 4, have a construction of a buckle including a joining or latch hole 41*a* in one clamping means 41 and a joining blade or latch mechanism 41*b* formed in the other clamping means 41', and is so designed as to maintain the clamped state of the clamping means by removeably joining the joining blade 41*b* into the joining hole 41*a* mentioned above.

Item 41*c* indicates a releasing operation button for releasing the clamping means from its clamped state.

Moreover, the clamping mechanism adopted in the buckle construction mentioned above can be any known clamping mechanism, and when the joining blade 41*b* is inserted into the joining hole 41*a*, a clamping mechanism (not illustrated in the Figures) inside the joining hole 41*a* is set to removeably interlock with the clamping hole 41*b*' by the effect of a springing force thus to secure the joint thus formed.

For release of the joining blade 41*b* from the joining hole 41*b*, the button 41*c* is provided in the clamping means 41, and a pressing action applied to the button works to push down the clamping mechanism (not illustrated in the Figures) provided under the releasing button, thereby releasing the joining blade from its clamped interlock with the clamping hole 41*b*'. The clamping construction of the clamping means 41 and 41 is not limited to the illustrated example, but can be modified freely into another construction.

The embodiment of the present invention as constructed in the manner mentioned hereinabove is to be used in the following way:

The infant chair, while not having a child in occupancy, is held in a state wherein the two frame members are biased open by the force of the spring 47 as described below, thus resulting in the clamping means 41 and 41' provided on the fore ends parts of the two frame members are not clamped with each other. That is to say, when the two clamping means 41 and 41' are not joined with each other for their clamping, the sliding motion unit 46, which is installed for free sliding motion on the guide rod 45, works so as to be thrust in the direction marked with the arrow mark a in in FIG. 5 by the thrusting force of the spring 47 which constantly applies a force directed backwards. As a result, the links 44 and 44 with the base end parts connected to the sliding motion unit 46 are pulled in the direction of the sliding motion of the sliding motion unit 46.

Figure 5:
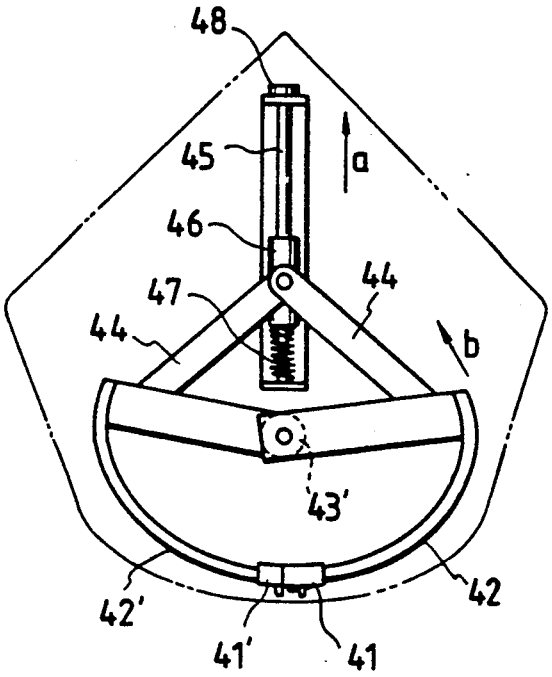
FIG. 5 is a plane view of the protective frame members alone in illustration of a closed state.
Figure 6:
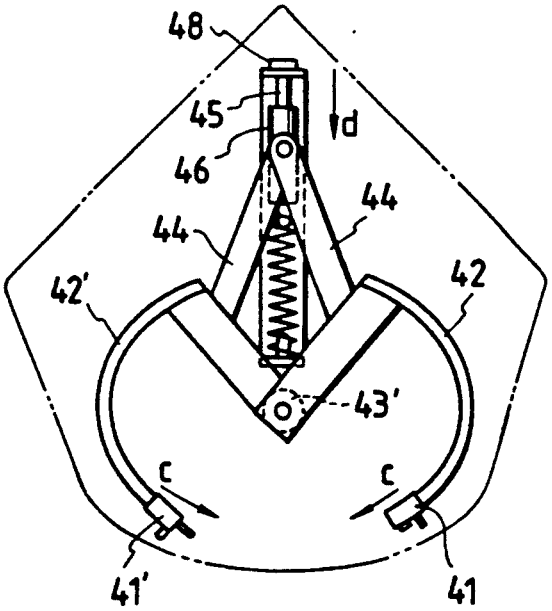
FIG. 6 is a plane view of the protective frame members alone in illustration of an opened state.

When the base end parts of the links 44 and 44 are pulled along with the sliding motion of the sliding motion unit 46, also the base end parts of the frame members 42 and 42' (to which the fore ends of the links are connected) will be swayed or scissored in the same direction (i.e. the direction indicated by the arrow mark b in FIG. 5, and consequently the two protective frame members 42 and 42' are retracted into the back support 21 for accommodation therein while maintaining an opened or released state (FIG. 6).

When the chair is to be used for confining and protecting an infant, the infant is first seated on the seat 2 formed on the upper part of the main body of the chair. After the infant is seated, the clamping means 41 and 41', which are exposed on both sides of the back support 21 are grasped and held by the guardian's hands and the entire frame members 42 and 42' are pulled forward in such a manner as drawing a locus around the infant's body (i.e. in the direction indicated by the arrow mark c in FIG. 6).

When the items are operated in this manner, the sliding motion unit 46, which had been thrust backward by the force of the spring 47, is pushed in a sliding motion in a forward direction along the sliding motion guide rod 45 in resistance to the force of the spring 47 (i.e. in the direction indicated by the arrow mark d in FIG. 6).

When the sliding motion unit 46 is thus put into sliding motion in the forward direction, the two links 44 and 44, one end each of which is connected to the sliding motion unit 46, are thrust to move forward, with the result that the frame members 42 and 42', which are connected with the links 44 and 44, are thereby drawn out and ultimately the clamping operation of the clamping means 41 and 41' is performed. When the closure of the protective frame 4 is completed with the clamping of the clamping means 41 and 41', the infant's body seated on the seat 2 can be held and protected in safety by means of the protective frame 4 as illustrated by the two-dot chain line in FIG. 2.

When it is desired to remove an infant seated on the seat 2, the clamping means 41 and 41' installed on the fore ends of the protective frame 4 must be released from a clamping state.

Specifically, the clamping of the blade **41*b* and the joining hole 41*a* are released by the pressing operation of the release operation unit 41*c*, which is mounted on the clamping means 41. When the clamping means 41 and 41' are thus released from their state of clamping, the frame members 42 and 42' are released instantly by the force of the spring 47**, as explained above, and, as the equipment thus no longer restrains the infant, it is possible easily to remove the seated infant.

The advantageous effects of the embodiment of the present invention as constructed in the manner described above are set forth as mentioned in the following:

Since the chair is constructed with the seat 2 formed in the upper part of the main chair body 1, which is formed in a columnar shape, it is possible to set the chair in a limited space, such as a corner in a lavatory compartment, a powder room, and an individual toilet room, and hence the infant chair according to this invention has been able fully to eliminate the various types of troubles associated with the provision of a conventional baby cot or the like and the inconvenience hitherto experienced when the guardian gets into the lavatory compartment together with the infant.

Since the protective frame 4 is installed on the seat 2 in a manner permitting the free opening and closing of the frame, it is possible to protect the infant seated in the chair for safety by means of the protective frame 4 mentioned above, even when the seated infant actively thrashes in a rough movement, and thus it is possible completely to prevent the occurrence of such an accident as a fall of the seated infant from the chair by mistake as the result of the infant's rough movement.

Since the infant can be accommodated in the chair 1 with a tall height, it is possible to keep the infant precisely under observation by the mother or the like, thereby ensuring the infant's safety.

When the infant is to be seated on the seat 2, it is possible to seat the infant by moving him horizontally from a point approximately in front of the chair owing to the fact that almost the whole structures of the semicircular arc frame members are accommodated in the main body 1 of the chair. Hence, it is not necessary to place the infant on the seat from a point over the chair, and, when the infant is seated, there is nothing interfering with the infant's legs, etc., and it is moreover not necessary to lift the infant to a high level, either. Therefore, it is easy to put the infant in the infant chair.

When the lock is released, almost the entire structure of the semicircular arc frame member 42 is automatically retracted into the inside area of the main unit 1 of the chair because force working in the opening direction is applied to the semicircular arc frame member 42. Therefore, when the infant is to be removed from the chair, it will be sufficient to draw the infant to this side, and it is possible easily to remove the infant since there is practically nothing interfering with withdrawal of the infant, unlike the case with the conventional infant chair.

What is claimed is:

1. An infant restraining chair comprising:

chair means for seating an infant therein;

restraining frame members means which can be selectively extended from, and retracted within, said chair means, said frame member means being in a fully extended position for restraining a waist and abdominal region of an infant;

securing means for selectively securing said restraining frame member means in a fully extended position; and retraction means, coupled to said restraining frame member means, for constantly applying force to said restraining frame member means so as to bias said retraining frame member means towards a retracted position within said chair means.

2. A chair as claimed in claim 1, wherein said infant restraining chair is for installation in a bathroom area for restraining an infant, said chair further comprising column support means for supporting said chair means at a predetermined height, wherein said chair means and column support means are constructed of a predetermined shape for installation in a predetermined area of said bathroom area.

3. A chair as claimed in claim 2, wherein a cross-section of said column support means is of a generally triangular shape, to facilitate installation of said chair in a corner area of said bathroom area.

4. A chair as claimed in claim 3, wherein said restraining frame member means comprises arcuate seat belt means of a substantially rigid construction, said arcuate seat belt means normally being in the retracted position within said chair means, and being selectably rotatable out of said chair means to encircle and restrain an infant within said chair means.

5. A chair as claimed in claim 4, wherein said securing means comprises lock means for locking said arcuate seat belt means in a restraining position.

6. A chair as claimed in claim 1, wherein a force of said retraction means is supplied using spring means.

7. A chair as claimed in claim 6, wherein said chair means comprises body support means for supporting and surrounding a substantial portion of an infant's body, and having an open front end for facilitating insertion and removal of an infant onto said body support means.

8. A chair as claimed in claim 7, wherein said chair means further comprises crotch holder means in the form of a projection from a surface of said chair means, said crotch holder means for positioning between a seated infant's legs and acting as a stop for preventing the infant from slipping out of said chair means.

9. A chair as claimed in claim 1, wherein said restraining frame member means comprises arcuate seat belt means of a substantially rigid construction, said arcuate seat belt means normally being in the restracted position within said chair means, and being selectively rotatable out of said chair means to encircle and restrain an infant within said chair means.

10. A chair as claimed in claim 9, wherein said securing means comprises lock means for locking said arcuate seat belt means in a restraining position.

11. A chair as claimed in claim 10, wherein a force of said retraction means is supplied using spring means.

12. A chair as claimed in claim 11, wherein said chair means comprises body support means for supporting and surrounding a substantial portion of an infant's body, and having an open front end for facilitating insertion and removal of an infant onto said body support means.

13. A chair as claimed in claim 12, wherein said chair means further comprises crotch holder means in the form of a projection from a surface of said chair means, said crotch holder means for positioning between a seated infant's legs and acting as a stop for preventing the infant from slipping out of said chair means.

14. A chair as claimed in claim 1, wherein said chair means comprises body support means for supporting and surrounding a substantial portion of an infant's body, said body support means having an open front end for facilitating insertion and removal of an infant onto said body support means, and crotch holder means in the form of a projection from a surface of said chair means, said crotch holder means for positioning between a seated infant's legs and acting as a stop for preventing the infant from slipping out of said chair means.

* * * * *